US006941839B1

(12) United States Patent
Syu

(10) Patent No.: US 6,941,839 B1
(45) Date of Patent: Sep. 13, 2005

(54) STRUCTURE OF A BOTTLE CORK OPENER

(75) Inventor: Cyong-Jyuan Syu, Tainan (TW)

(73) Assignee: Holo Electronics Co., Ltd., Tainan (TW)

( * ) Notice: Subject to any disclaimer, the term of this patent is extended or adjusted under 35 U.S.C. 154(b) by 15 days.

(21) Appl. No.: 10/800,744

(22) Filed: Mar. 16, 2004

(51) Int. Cl.[7] ..... B67B 7/08
(52) U.S. Cl. ..... 81/3.2; 81/3.48
(58) Field of Search ..... 81/3.2, 3.48

(56) References Cited

U.S. PATENT DOCUMENTS 1,921,811 A * 9/1933 Ludwig ..... 81/3.2
2,729,124 A * 1/1956 Farandatos ..... 81/3.2
5,012,703 A * 5/1991 Reinbacher ..... 81/3.29
2005/0076741 A1 * 4/2005 Chan ..... 81/3.2

* cited by examiner

*Primary Examiner*—David B. Thomas
(74) *Attorney, Agent, or Firm*—Rosenberg, Klein & Lee

(57) ABSTRACT

A cork opener includes a hollow handle, an air pump, first and second hollow fitting units; the pump has a piston rod connected to the handle; the pump is passed through upper end of the first fitting unit, and displaceable relative to the same; the first unit has a hole at lower end for an outlet needle of the air pump to be passed through; the first fitting unit has a displacement portion, which is extended from the lower end, and formed with guide gaps, and which is passed through upper end of the second fitting unit, which has position-limiting blocks respectively movably held in the guide gaps; thus, a cork of a bottle can be removed from the bottle by means of moving the handle up and down to pump air into the bottle after the needle has been inserted through the cork to communicate with inside of the bottle.

6 Claims, 7 Drawing Sheets

STRUCTURE OF A BOTTLE CORK OPENER

BACKGROUND OF THE INVENTION

1. Field of the Invention

The present invention relates to a bottle cork opener, which includes a handle unit, and an air pump having an outlet needle for insertion through a cork, and is operated to pump air into the bottle to remove the cork by means of moving the handle unit up and down, more particularly one, which is made such that air resistance, which is formed in upward and downward movements of the handle unit, can be reduced for operation to be smoother as well as for the length of time taken in operation to be shortened.

2. Brief Description of the Prior Art

Referring to FIG. 1, a conventional cork opener 1 includes a handle 10, and a spiral-shaped part 12, which has a pointed lower end, and is secured to the handle 11 at an upper end. In using the cork opener 1 to remove a cork of a bottle, first the spiral-shaped part 12 is inserted in the cork at the pointed lower end thereof, and the handle 11 is turned to make the spiral-shaped part 12 further inserted into, and securely connected to the cork. Then, the cork opener is pulled upwards relative to the bottle such that the cork is separated from the bottle.

However, because the cork is relatively tightly fitted in the neck of the bottle, in case the cork opener has not been inserted into the cork at enough depth, the cork can't be easily pulled out of the bottle, and can be broken during the upward movement of the cork opener. And, small pieces of the cork can be formed, and fall into the contents of the bottle in case the cork opener has not been inserted into the cork too deeply.

SUMMARY OF THE INVENTION

It is a main object of the present invention to provide a bottle cork opener, which can be smoothly operated, and with which a cork can be opened very rapidly.

The bottle cork opener of the present invention includes a hollow handle unit, an air pump, first and second hollow fitting units. The air pump includes a hollow main body, an outlet needle secured on the a lower end of the hollow main body, and a piston rod passed through an upper end, and displaceable relative to the hollow main body; the piston rod is securely connected to the securing part of the handle unit at an upper end; the hollow main body has a limiting portion on an upper end, and a stopping part on a lower end. The first fitting unit has a limiting part on an upper end, which has a first hole. The main body of the pump is passed through the first hole, and displaceable relative to the first fitting unit; the limiting portion of the air pump is shaped so as not to move into the first fitting unit; the stopping part of the lower end of the air pump main body is shaped so as not to move outside the first fitting unit. The first fitting unit has a through hole at a lower end for allowing the outlet needle of the air pump to be passed through. The first fitting unit has a displacement portion, which is extended from the lower end, and formed with several guide gaps. The displacement portion of the first fitting unit is passed through an upper end of the second fitting unit. The second fitting unit has several position-limiting blocks projecting from the upper end and respectively movably held in the guide gaps of the displacement portion. Thus, a cork of a bottle can be removed from the bottle by means of moving the handle unit up and down after the outlet needle has been inserted through the cork to communicate with inside of the bottle.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
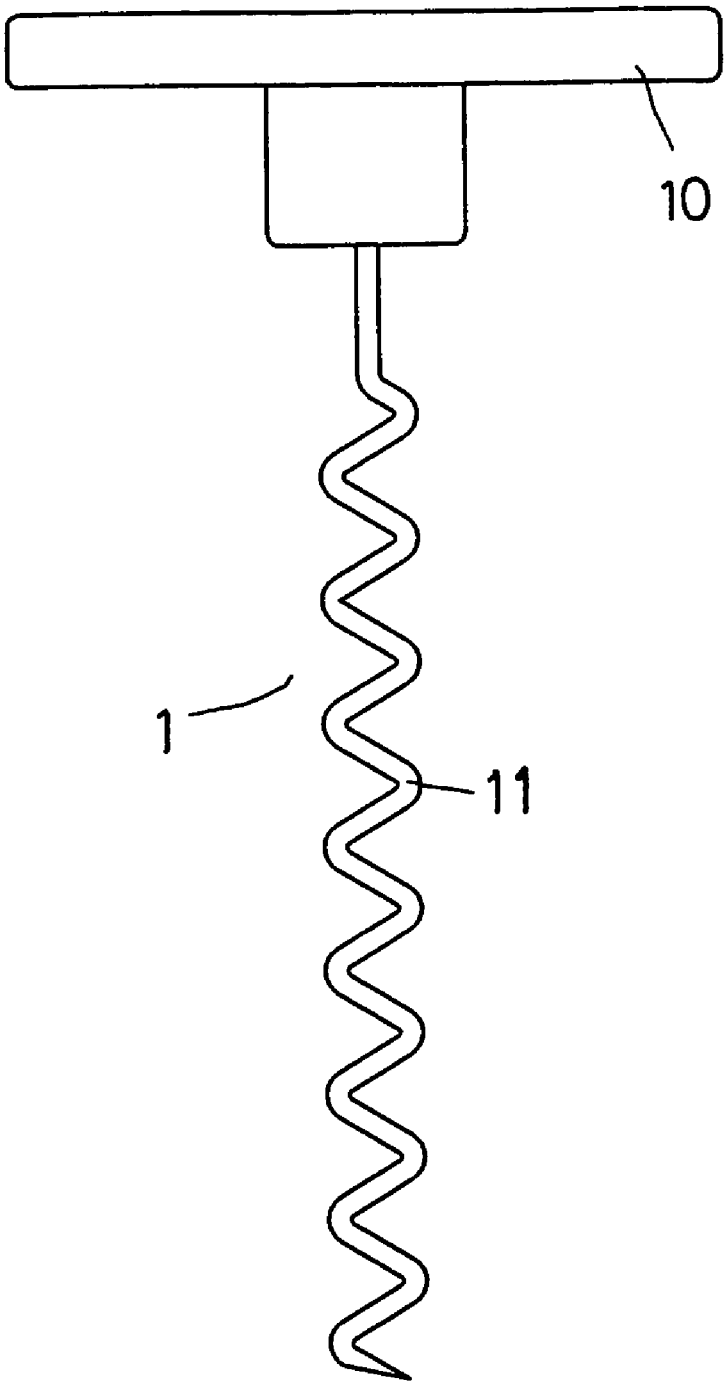
F I G. 1 (PRIOR ART)
FIG. 1 is a front view of the conventional cork opener.
Figure 2:
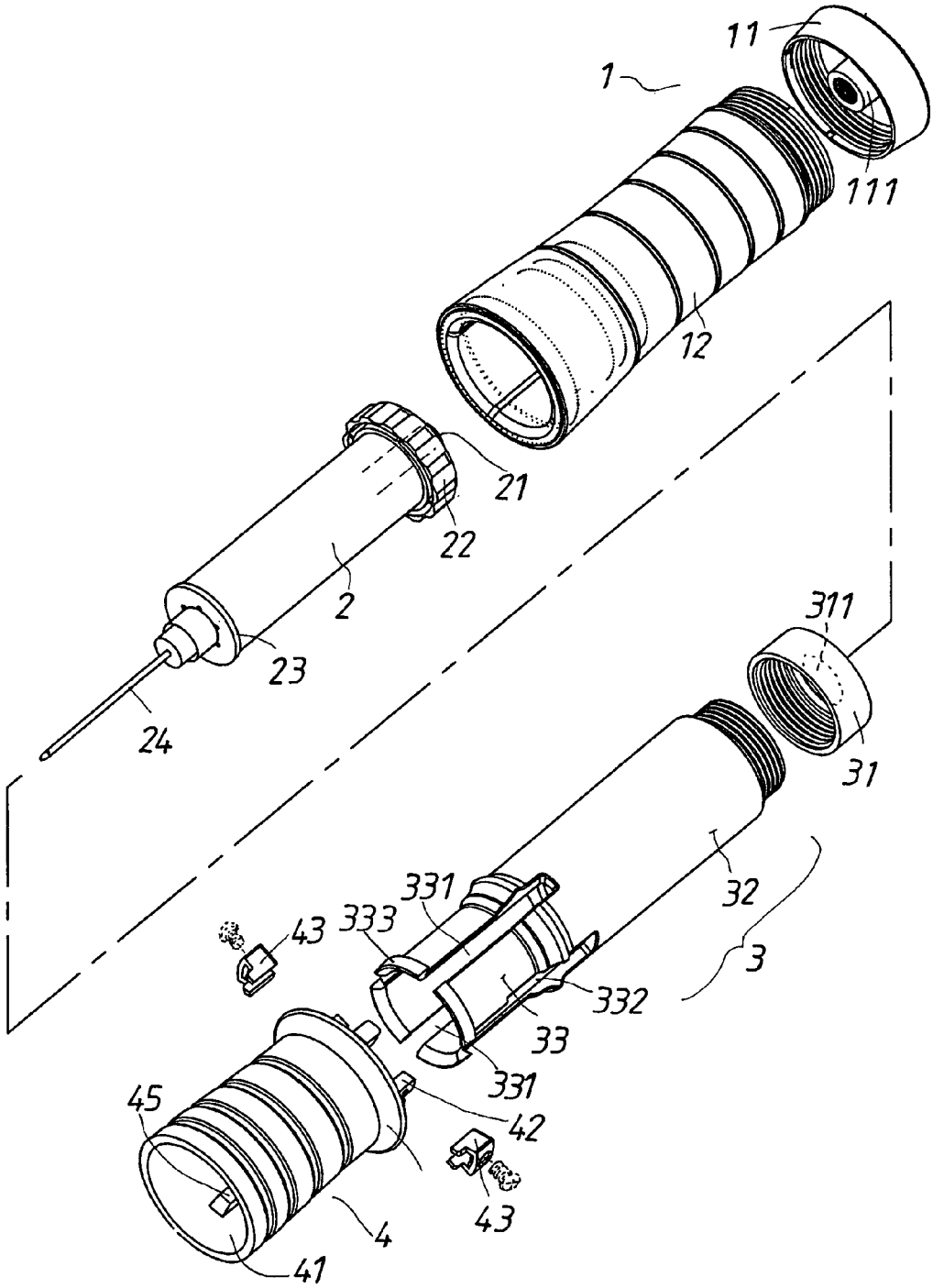
FIG. 2 is an exploded perspective view of the bottle cork opener according to the present invention.
Figure 3:
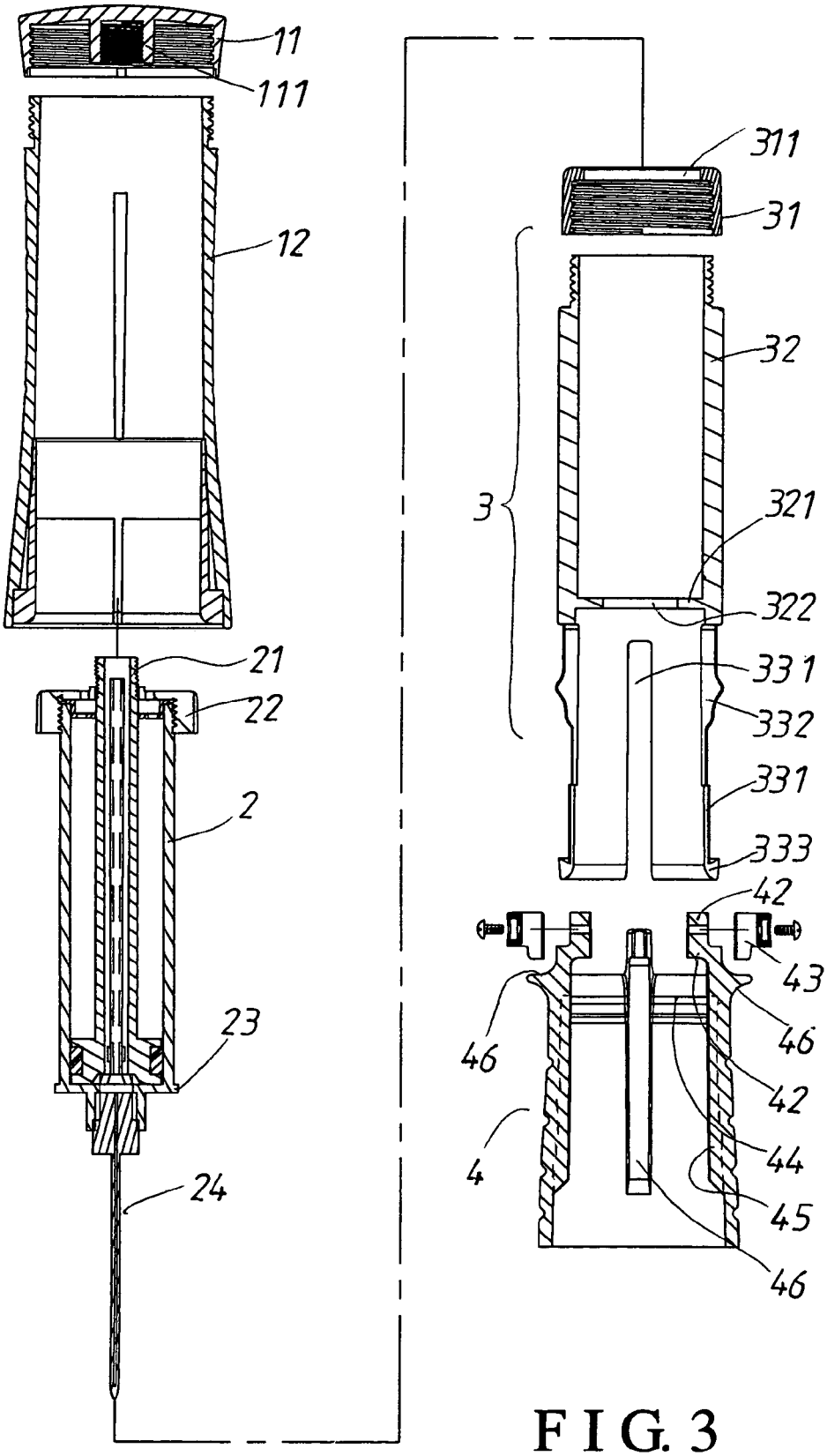
FIG. 3 is an exploded cross-sectional view of the present invention.

Referring to FIGS. 2 and 3, a preferred embodiment of a bottle cork opener in the present invention includes a handle unit 1, an air pump 2, a first fitting unit 3, and a second fitting unit 4.

The handle unit 1 includes a securing part 11, and a hollow handle part 12. The hollow handle part 12 has screw threads on an outer side of an upper end thereof while the securing part 11 has screw threads on an inner side thereof. The securing part 11 is securely connected to the upper end of the handle part 12 with the help of the screw threads. The securing part 11 is formed with a connecting portion 111 whose inner side is formed with screw threads.

The air pump 2 includes a hollow main body, a piston rod 21, a limiting part 22, a stopping part 23, and an outlet needle 24, and is made such that air will travel into it in both forward and rearward movements of the piston rod 21. The air pump 2 is equipped with control devices, and valves at upper and lower ends thereof such that the valves will be opened, and air drawn into it when the piston rod 21 is drawn; thus, air will be drawn into, and pumped from the air pump 2 in each drawn movement of the piston rod 21. The air pimp 2 is a heretofore known art, and isn't the subject of the present invention therefore it won't be further detailed herein. The limiting part 22 is detachably secured on an upper end of the hollow main body, and is shaped like a cap of the air pump 2. The stopping part 23 is secured on the lower end of the hollow main body while the outlet needle 24 is secured to the stopping part 23. The piston rod 21 is passed through the upper end of the hollow main body, and is formed with screw threads on an upper end thereof, and securely connected to the connecting portion 111 of the handle unit 1 at the upper end with the help of the screw threads.

The first fitting unit 3 includes a limiting part 31, a hollow containing part 32, and a displacement portion 33 extended from a lower end of the hollow containing part 32, and is connected to the air pump 2 such that it can slide along an inner room of the handle part 12 of the handle unit 1, and such that the air pump 2 can slide along an inner room thereof. The limiting part 31 is like a cap, and has screw threads (not numbered) on an inner side thereof, and a through hole 311 on a top thereof. The hollow containing part 32 has a stopping portion 321 above the displacement portion 33 on an inner side thereof, and a through hole 322, which is defined by the stopping portion 321. The displacement portion 33 is formed with several elongated guide gaps 331 thereon, and position-limiting protrusions 333 on an outward side of a lower end thereof. Furthermore, displacement spaces 332, 332 are provided adjacent to two selected opposing ones of the elongated guide gaps 331 at an upper end of the displacement portion 33; thus, the selected opposing elongated guide gaps 331, 331 each has an upper portion wider than a lower portion.

Figure 7:
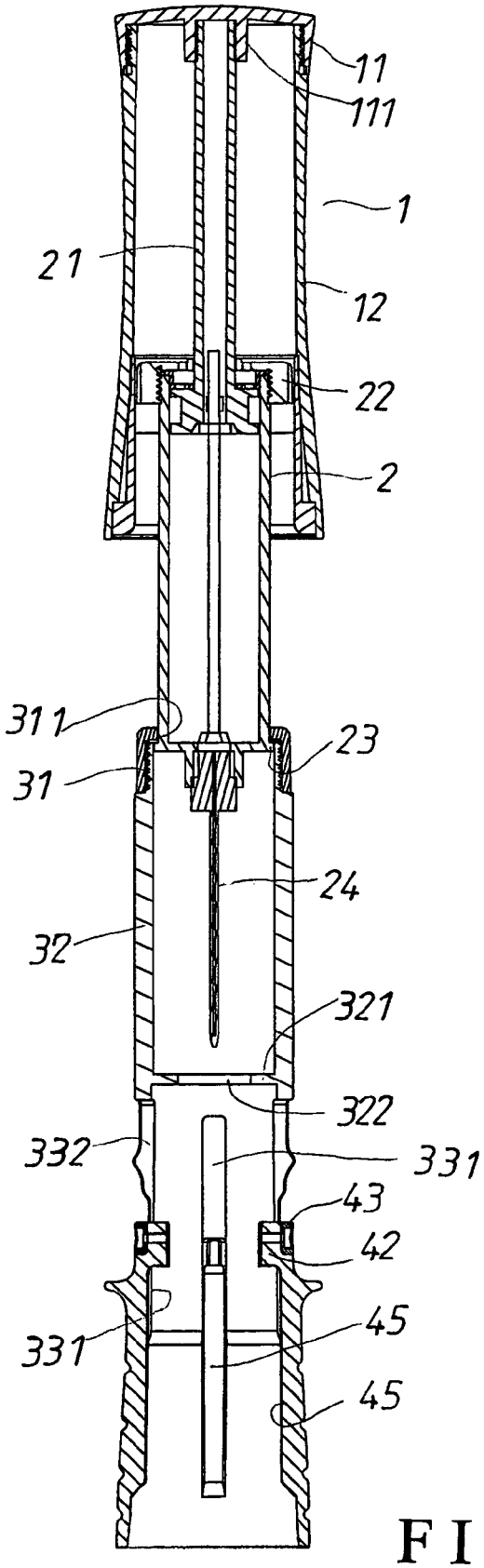
FIG. 7 is a third cross-sectional view of the present invention.

The second fitting unit 4 has a hollow containing portion 41, several extension portions 42 on an inner side of an upper end of the hollow containing portion 41, an annular stopping protrusion 44 on the inner side near the upper end, several guide rails 45 on the inner side, and a stopping portion 46 on an outward side near the upper end thereof. The displacement portion 33 of the first fitting unit 3 is passed into the hollow containing portion 41 with the extension portions 42 being respectively positioned in the guide gaps 331 thereof, and with the position-limiting protrusions 333 being under the annular stopping protrusion 44, and with the guide rails 45 being respectively in the guide gaps 331; thus, the position-limiting protrusions 333 will come into contact with the annular stopping protrusion 44 when the first fitting unit 3 is upwards displaced relatively to the second fitting unit 4, and in turns, the first fitting unit 3 can't separate from the second fitting unit 4. Two position limiting blocks 43, each of which tapers towards an upper end, and has inverted-L shape, are respectively secured on two opposing ones of the extension portions 42 so as to be in the upper sections of the two selected guide gaps 331, 331, which have the displacement spaces 332, 332 formed next thereto to have an upper portion wider than a lower portion; thus, the position limiting blocks 43 can only be moved within the wider upper sections of the guide gaps 331, and in turns, the first fitting unit 3 can only be up and down displaced relative to the second fitting unit 4 for a short distance accordingly. The stopping portion 46 of the second fitting unit 4 is provided for preventing the handle unit 1 from moving past it during the downward movement of the handle unit 1, as shown in FIG. 7.

Figure 4:
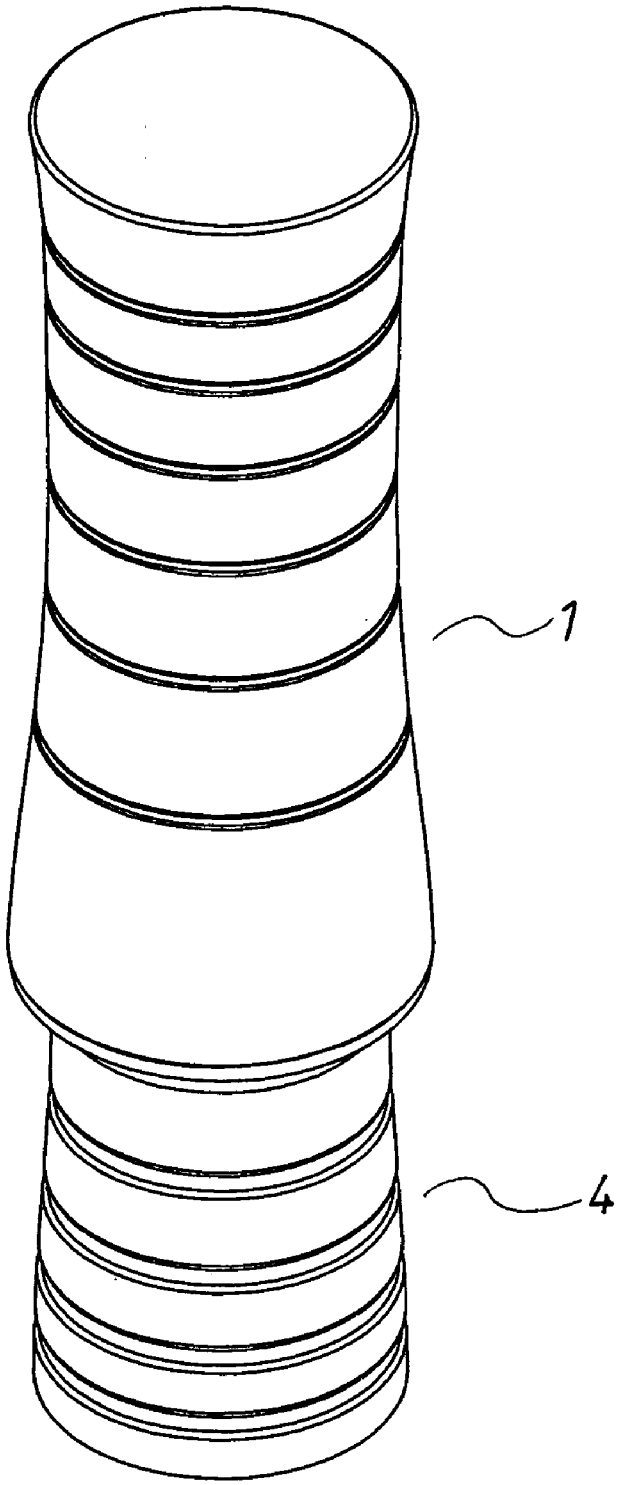
FIG. 4 is a perspective view of the present invention.
Figure 5:
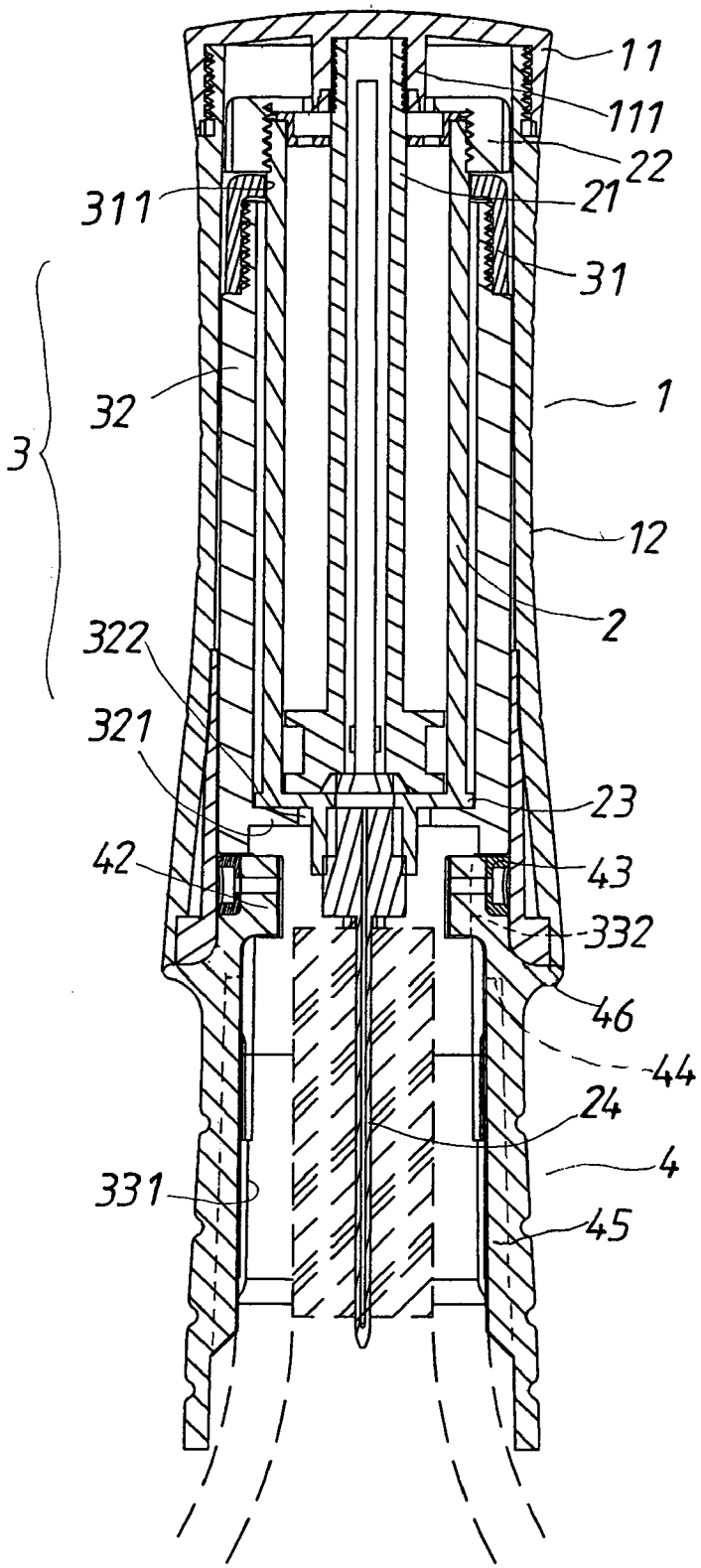
FIG. 5 is a first cross-sectional view of the present invention (secured to a cork of a bottle)

In assembling the present bottle cork opener, referring to FIGS. 4 and 5, first, the air pump 2 is passed into the hollow containing part 32 of the first fitting unit 3 with the outlet needle 24 being passed through the through hole 322 and into the displacement portion 33, and with the stopping part 23 being pressed against the stopping portion 321. Then, the limiting part 31 and the hollow containing part 32 of the first fitting unit 3 are joined, and the limiting portion 22 is secured on the upper end of the air pump 2 above the first fitting unit 3; thus, the stopping part 23 is displaceable along, and confined in the containing part 32. Next, the displacement portion 33 of the first fitting unit 3 is passed into the second fitting unit 4 with the guide rails 45 being respectively held in the lower end portions of the guide gaps 331. And, the two position-limiting blocks 43 are secured to the respective extension portions 42, and passed into and confined in respective ones of the two selected guide gaps 331 such that displacement of the second fitting unit 4 relative to the first fitting unit 3 is limited with the position-limiting blocks 43 being only capable of moving within the wider upper end portions of the selected guide gaps 331, which have the displacement spaces 332 provided next thereto. Next, the limiting portion 22 of the air pump 2 is rested on the limiting part 31 of the first fitting unit 3, and the handle unit 1 is positioned around the first fitting unit 3, and the upper end of the piston rod 21, which projects out from the limiting part 31, is securely connected to the securing part 11 of the handle unit 1. Thus, assembly of the bottle cork opener is finished, and the opener is in a compressed not-in-use position.

Figure 6:
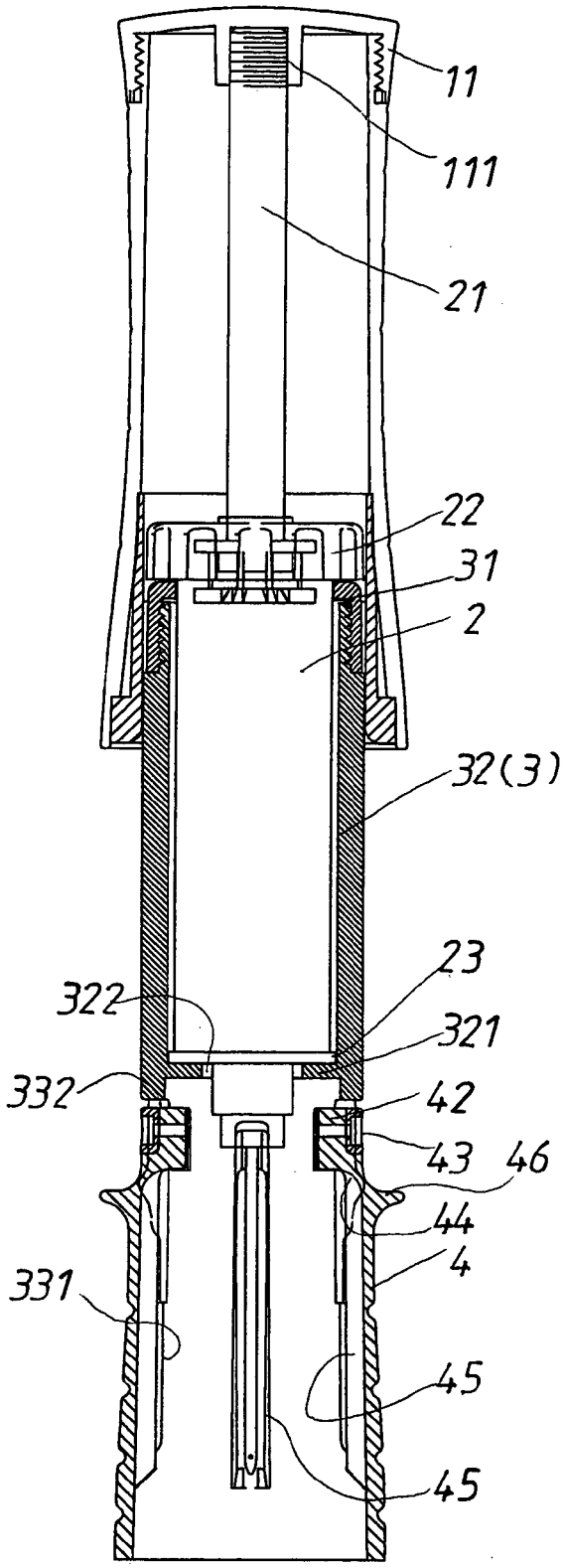
FIG. 6 is a second cross-sectional view of the cork opener according to the present invention.

Referring to FIG. 6, to open a cork of a bottle, the user inserts the outlet needle 24 through the cork while holding the second fitting unit 4 with one hand; thus, the lower end of the outlet needle 24 projects down form the bottom of the cork. Then, the user moves the handle unit 1 up and down while holding the handle part 12 with the other hand; thus, air is forced to move into the bottle through the outlet needle 24; because air can be forced to move into the bottle only in downward movement of the piston rod 24 but also in the upward drawn movement of the same, air pressure will increase very rapidly in the bottle.

The reason why there are both the first and the second fitting units 3 and 4 provided in the present invention, which are displaceable relative to each other, instead of single fitting unit is because in the upward drawn movement of the handle unit 1, some air will be caused to move in between the first and the second fitting units 3 and 4 to form upward drawing force, and effect of such upward drawing force of air has to be reduced; in upward drawn movement of the handle unit 1, the first fitting unit 3 will move upwards slightly owing to the upward drawing force of air, but the second fitting unit 4 won't therefore position of the second fitting unit 4 won't be changed. Furthermore, air resistance against the handle unit 1, which will form in downwardly depressed movement of the handle unit 1, can be reduced owing to the guide gaps 331, and the handle unit 1 can be more smoothly operated, allowing the cork to be opened soon after the handle unit 1 is operated. In other words, it takes relatively short time to open a cork with the present cork opener. After the cork is removed from the bottle, it will be held in the second fitting unit 4.

Referring to FIG. 7, the user has to stretch the present cork opener while holding the handle unit 1 with one hand, and the second fitting unit 4 with the other hand in case he wants to remove the cork from the opener after having removed the cork form the bottle; during the displacement of the handle unit 1 away from the second fitting unit 4, the first fitting unit 3 will be stopped from moving further by the position-limiting blocks 43, the air pump 2 will be moved in the same direction as the handle unit 1, and the cork will be pressed against the lower side of the stopping portion 321 of the first fitting unit 3. Consequently, the cork will separate from the outlet needle 24 a short time before the air pump 2 is moved to such a position that the stopping part 23 thereof is pressed against, and stopped by the limiting part 31 of the first fitting unit 3.

From the above description, it can be easily understood that the bottle cork opener of the present invention has advantages as followings:

1. The handle unit 1, the air pump 2, the first and the second fitting units 3 and 4 are connected such that they can be smooth displaced relative to each other without possibility of shake therefore service life of the present cork opener will be longer.
2. The outlet needle of the air pump 2 can't project out from the cork opener therefore the cork opener is safe to use.
3. Because the opener is equipped with the first and the second fitting units 3 and 4, which are displaceable relative to each other for reducing air resistance in downward movement of the handle unit 1, the handle unit 1 can be smoothly operated, and it takes relatively short time to open a cork with the present cork opener.
4. The air pump 2 can pump air through the outlet needle 24 thereof not only in downward movement of the handle unit 1 but also in upward movement of the same therefore the length of time taken to open a cork can be reduced.

5. A cork will certainly be opened when the present cork opener is used therefore it is more convenient to use than the conventional spiral-shaped cork opener as described in the Background, which can cause a cork to break in case it isn't properly used.
6. A cork can be easily separated from the cork opener by means of stretching the opener after the cork has been removed from a bottle therefore the cork opener is convenient to use.

What is claimed is:

1. A bottle cork opener, comprising a handle unit including a hollow handle part, and a securing part secured on an upper end of the handle part;

an air pump including:

(1) a hollow main body having a limiting portion secured on an upper end thereof, and a stopping part secured on a lower end thereof;

(2) an outlet needle secured on the stopping part of the lower end of the hollow main body;

(3) a piston rod passed through the upper end limiting portion, and displaceable relative to the hollow main body; the piston rod being securely connected to the securing part of the handle unit;

a first fitting unit including:

(1) a hollow containing part having a limiting part, which is secured on an upper end, and which has a through hole; the hollow main body of the air pump being passed through the through hole, and displaceable relative to the hollow containing part; the limiting portion of the air pump being positioned above the upper end of the first fitting unit; the limiting portion of the air pump being formed with such a size that it will be stopped by the limiting part of the first fitting unit; the limiting part of the first fitting unit being capable of preventing the stopping part of the lower end of the air pump main body from moving outside the first fitting unit through it; the hollow containing part having a stopping portion on an inward side of a lower end thereof for stopping the stopping part of the lower end of the hollow main body of the air pump with; the stopping portion having a through hole for allowing the outlet needle of the air pump to be passed through;

(2) a displacement portion extended from a lower end of the hollow containing part; the displacement portion being formed with a plurality of spaced guide gaps;

a second fitting unit having a hollow containing portion; the displacement portion of the first fitting unit being passed through an upper end of the hollow containing portion; the hollow containing portion having a plurality of position-limiting blocks projecting from the upper end thereof and respectively movably held in the guide gaps of the displacement portion;

whereby a cork of a bottle can be removed from the bottle by means of moving the handle unit up and down after the outlet needle has been inserted through the cork to communicate with inside of the bottle.

2. The bottle cork opener as claimed in claim 1, wherein the air pump is made in such a way as to be capable of pumping air through the outlet needle in forward movement as well and rearward movement of the piston rod thereof.

3. The bottle cork opener as claimed in claim 1, wherein the guide gaps of the displacement of the first fitting unit have upper end portions than lower end portions thereof, and the position-limiting blocks of the second fitting unit are confined in the upper end portions of the second fitting unit such that the first and the second fitting units are displaceable relative to each other without possibility of falling apart.

4. The bottle cork opener as claimed in claim 1, wherein the position-limiting blocks of the second fitting unit are secured to the hollow containing portion.

5. The bottle cork opener as claimed in claim 1, wherein the second fitting unit is formed with a plurality of guide rails on an inner side thereof, which are respectively held in the guide gaps of the first fitting unit.

6. The bottle cork opener as claimed in claim 1, wherein the first fitting unit is formed with a position-limiting protrusion on an outer side of a lower end thereof, and the second fitting unit is formed with a stopping protrusion on an inner side near the upper end thereof for stopping the position-limiting protrusion of the first fitting unit with.

* * * * *